US006397710B1

(12) United States Patent
Baker

(10) Patent No.: US 6,397,710 B1
(45) Date of Patent: Jun. 4, 2002

(54) SCREWDRIVER WITH SLOTTED BLADES

(75) Inventor: David R. Baker, Fort Worth, TX (US)

(73) Assignee: David Baker Inc., Fort Worth, TX (US)

( * ) Notice: Subject to any disclaimer, the term of this patent is extended or adjusted under 35 U.S.C. 154(b) by 0 days.

(21) Appl. No.: 09/668,269

(22) Filed: Sep. 22, 2000

Related U.S. Application Data

(60) Provisional application No. 60/155,117, filed on Sep. 22, 1999.

(51) Int. Cl.[7] ..... B25B 23/00
(52) U.S. Cl. ..... 81/460; 81/436
(58) Field of Search ..... 81/436, 438, 460, 81/441

(56) References Cited

U.S. PATENT DOCUMENTS

| | | | | | |
|---|---|---|---|---|---|
| 1,782,981 | A | * | 11/1930 | Anderson | 81/441 |
| 3,409,058 | A | * | 11/1968 | La Pointe | 81/460 |
| 3,831,648 | A | * | 8/1974 | Hill et al. | 81/460 |
| 3,985,170 | A | | 10/1976 | Iskra | |
| 4,105,056 | A | * | 8/1978 | Arnn | 81/436 |
| 4,111,078 | A | * | 9/1978 | Seamon | 81/441 |
| 4,434,688 | A | | 3/1984 | Bowles | |
| 4,998,454 | A | | 3/1991 | Chaconas et al. | |
| 5,224,402 | A | | 7/1993 | Pettersson | |
| 5,269,209 | A | | 12/1993 | Baker | |
| 6,216,569 | B1 | * | 4/2001 | Hu | 81/436 |

FOREIGN PATENT DOCUMENTS

| | | | | |
|---|---|---|---|---|
| WO | WO 90/01399 | * | 2/1990 | 81/460 |

OTHER PUBLICATIONS

Phillips Head Screwdriver, A Man's Life, Cosmic Toolkit at http://www.manslife.com/hardmach.
Untitled Document at http://www.sears.com.
Thomas Register of American Manufacturers at http://www5.thomasregister.com.

* cited by examiner

*Primary Examiner*—Joseph J. Hail, III
*Assistant Examiner*—Joni B. Danganan
(74) *Attorney, Agent, or Firm*—Bracewell & Patterson, L.L.P.

(57) ABSTRACT

A cross-point shaped screwdriver has a cylindrical metal shaft with an axis coaxial with an insertion direction for driving a screw having a socket. A bit section, formed on the end of the shaft, has four blades. A circumferential groove is formed in the exterior of each of the blades. The grooves are in a single plane extending across a width of each plane.

When the screwdriver engages the screw socket, the grooves substantially align with a top portion of the socket. The grooves provide a clearance between the bit section and upper end of the socket top, thereby reducing wear on the screw socket and permit the driver to engage and drive the screw at a depth that the standard driver can not engage and drive upon. Often the screw is rounded out by a standard driver.

12 Claims, 7 Drawing Sheets

SCREWDRIVER WITH SLOTTED BLADES

CROSS REFERENCE TO RELATED APPLICATIONS

This application claims the benefit of priority of U.S. Provisional Application, Ser. No. 60/155,117 which was filed on Sep. 22, 1999.

BACKGROUND OF THE INVENTION

This invention relates in general to screwdrivers for driving Phillips-type socket screws. These type of screwdrivers are also known as Cross head, star, Pozidriv and Reed & Prince. In particular this invention relates to a screwdriver with an improved blade configuration.

Referring to FIG. 1, a prior art Phillips or cross-point, No.2 screwdriver 11 has a drive axis 13 and a bit 15 at its distal end. Bit 15 has four orthogonal blades 17 that are each tapered at approximately 26 degrees or less relative to drive axis 13. The tip 19 of bit 15 is further tapered from the blades 17 to form a conical point. Screwdriver 11 is sized for driving socket screws such as the No.2 screw 21 shown, although screwdriver 11 could also drive No.1 or No.3 screws as well. Screw 21 has an axis 23 and a countersunk head 25 with a slotted socket 27. When viewed from above, slotted socket 27 appears as a cross or addition symbol that is well suited to be driven by the orthogonal blades 17 of screwdriver 11. Socket 27 has an axial depth of approximately 0.125 inches into head 25, although screwdriver 11 penetrates only about 0.100 inches therein.

The tapered inner surfaces of socket 27 are inclined at an angle that is approximately 26 degrees or more relative to axis 23. The difference in tapers between blades 17 and socket 27 allow screwdriver 11 to be easily inserted and removed from screw 21 during operation. However, the taper difference also forces screwdriver 11 to contact screw 21 exclusively along its socket threshold region, indicated by brackets 29. Since contact points 29 are unsupported above the top surface of screw 21, socket 27 will tend to wear over time and may even become stripped out and unusable. Also note that the deep penetration of screwdriver 11 into screw 21 and the similarities of their tapers prevent the axis 13 of screwdriver 11 from being tilted more than about one degree off axis 23 of screw 21 (i.e. two degrees total in any plane). Sometimes it is not possible to be within one degree due to obstructions, making it difficult to properly drive screw 21.

Phillips head type screwdrivers are also known to "cam-out" of the screw socket while in use. The term "cam-out" is known in the art and refers to the tendency of the screw blades when under increasing torque to move out of the screw slot. This may occur in a violent manner, injuring the hands of the user and damaging the screw socket, thereby making it difficult for repeat applications of a screwdriver.

SUMMARY OF THE INVENTION

A Phillips-shaped screwdriver has a cylindrical metal shaft having an axis coaxial with an insertion direction for driving a screw having a socket. The bit section is formed on a distal end of the shaft and has a diameter equal to the shaft, tapering to a conical portion. The bit section has a first circumferential groove formed in the exterior. Blades are formed on the bit section and consequently each blade has a groove extending across its width that is in a common plane with each other blades groove. A distal end of the first groove is substantially axial where it intersects the bit section. When the screwdriver engages the screw socket, the conical portion inserts to a depth which allows the circumferential groove to substantially align with a top portion of the socket, and a surface area on the bit section engages an interior surface area of the socket for transmitting torque receiving surfaces. The circumferential groove provides a clearance between the bit section and socket top. This design provides a wobble of four degrees total. A variety of shapes may be selected for the circumferential groove. Typically, convex, concave, flat, straight, and v-shaped grooves have been chosen, but any combination of the above may be selected to obtain desired characteristics relating to "cam-out" and a force required to pull it from the screw socket while under torque load. The number of grooves provided on each blade of the bit will vary with the number of different size screws that can be driven by that bit. In another embodiment, the bit section is formed on a distal end of the shaft and has a diameter equal to the shaft tapering to a frustoconical portion. In this design the amount of wobble may be up to six degrees total.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE INVENTION

Figures 1, 2, 3:
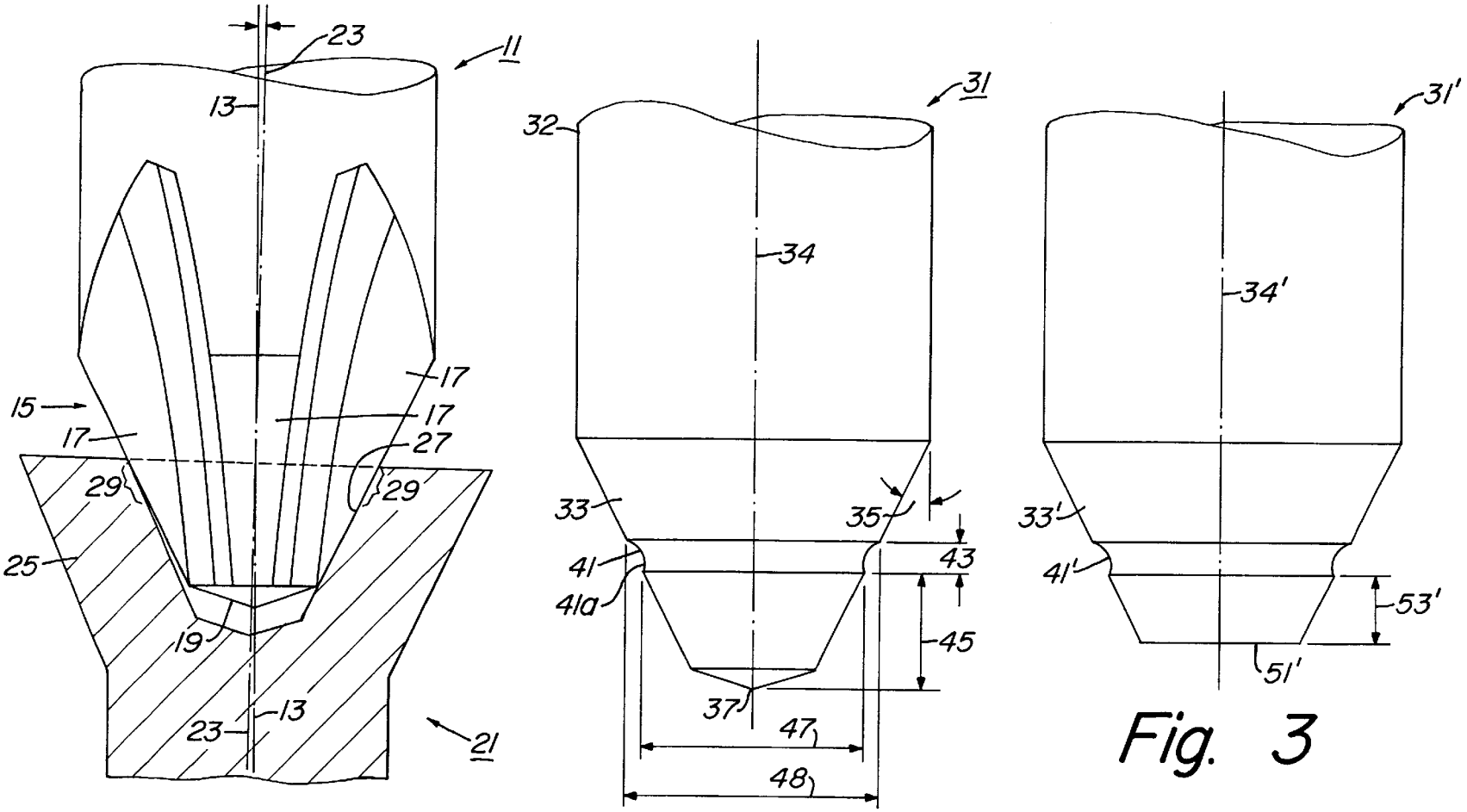
Fig. 1 (PRIOR ART)
FIG. 1 is a side view of the bit of a prior art Phillips-type screwdriver inserted into a sectioned, conventional No.2 Phillips-type socket screw.
FIG. 2 is a side view of the bit of a first embodiment of a screwdriver with a tapered tip that is constructed in accordance with the invention and prior to formation of the blades of the screwdriver.
FIG. 3 is a side view of the screwdriver of FIG. 2 with a truncated tip.

Referring now to FIG. 2, a first embodiment of the invention is shown as screwdriver 31. FIG. 2 shows screwdriver 31 having a cylindrical metal shaft 32 with a head having an unfinished bit section 33 formed on a distal end of the cylindrical metal shaft 32 prior to the formation of its blades 49. Screwdriver 31 may be sized as a No.1, No.2, or No.3 Phillips-type or cross-point screwdriver. These sizes differ in diameter. Screwdriver 31 has an axis 34, which is coaxial with an insertion direction for driving a screw having a socket 61. The insertion direction is indicated by an arrow in FIG. 4, and for ease of understanding the drawings, it is noted that one ordinarily skilled in the art would understand that a screwdriver is inserted into a socket in this manner. Screwdriver 34 also has a conical taper 35 of 25.5 to 26 degrees, and a sharply tapered conical point or tip 37. Taper 35 is approximately the same, whether a No.1, No.2, or No.3 screwdriver is selected. Screwdriver 31 also has a concave, circumferential groove 41 formed in the exterior of cross-point bit section 33 prior to forming the blades. Usually four blades 49 are formed. Alternatively, groove 41 may also be formed in bit section 33 after the blades are machined. It should be clear that in a typical cross point type screwdriver or bit, there are four blades 49 machined or formed on the bit by conventional techniques. These four blades 49 engage mating shoulders of four slots in a head of a screw in operation. The grooves 41 are formed in a single plane extending across the width of each blade 49 of the bit section 33. Each blade 49 is separated from an adjacent blade 49 by a recess (not shown). Each blade 49 has an outer edge 49*a* being inclined relative to the axis 34. The grooves 41 are in a common plane for providing a clearance between the bit section 33 and an upper edge 62 of the socket 63 of a screw 61. Groove 41 is perpendicular to axis 34. In one version, groove 41 has an axial dimension 43 of approximately 0.023 inches, is spaced apart from tip 37 by an axial distance 45 of about 0.085 inches, and has a radius of curvature of 0.016 inches. Note that the distal end 41*a* of groove 41 is substantially axial, or cylindrical where it intersects bit 33, although it does not flare out some. Groove 41 has a minor diameter 47 of approximately 0.160 inches and a major diameter 48 of approximately 0.18 inches. Groove 41 may be other configurations and dimensions in cross-section, such as a flat or a V-shape (see FIGS. 17–21).

In a second embodiment, a screwdriver 31' otherwise identical to screwdriver 31, may be configured with a flat, frustoconical tip 51' (FIG. 3) that gives bit 33' a slightly shorter axial length than the version of FIG. 2. Concave circumferential groove 41' is identical in this version, but is axially spaced apart from tip 51' by an axial distance 53' of only about 0.049 inches. The advantage of this alternate configuration will be explained below.

Figure 4:
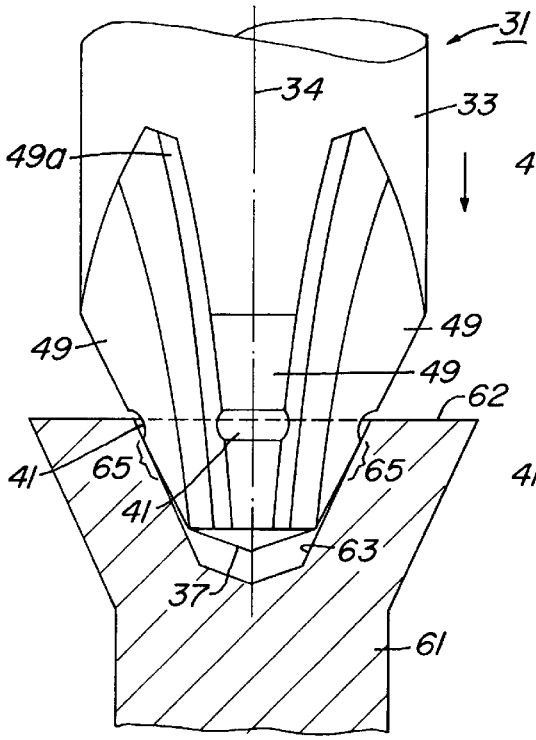
FIG. 4 is a side view of the screwdriver of FIG. 2 after formation of the blades and inserted into the screw of FIG. 1.

Referring now to FIG. 4, screwdriver 31 is a cross-point type, having four orthogonal blades 49 (three shown) that are formed in a conventional manner, either before or after groove 41 is formed in bit 33. Screwdriver 31 is shown inserted in a conventional socket screw 61 to a typical depth such that blades 49 are seated in the cross-shaped socket 63 thereof. In this embodiment, screwdriver 31 is matched to the size of screw 61. Note how groove 41 is precisely located on each blade 49 to straddle the outer edges of socket 63. Thus, portions of groove 41 are located both inside and outside of socket 63. This position causes blades 49 to engage socket 63 below its outer edges at the areas indicated by brackets 65. Relocating the driving force to areas 65 increases the surface contact area between bit 33 and screw 61 while reducing wear and eliminating stripping of socket 63.

Figure 8:
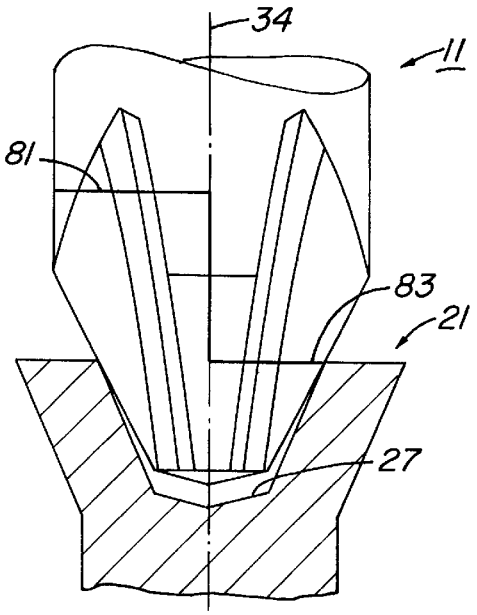
FIG. 8 is a side view of the screwdriver and screw of FIG. 1 illustrating the force and moment arms required during operation.
Figure 9:
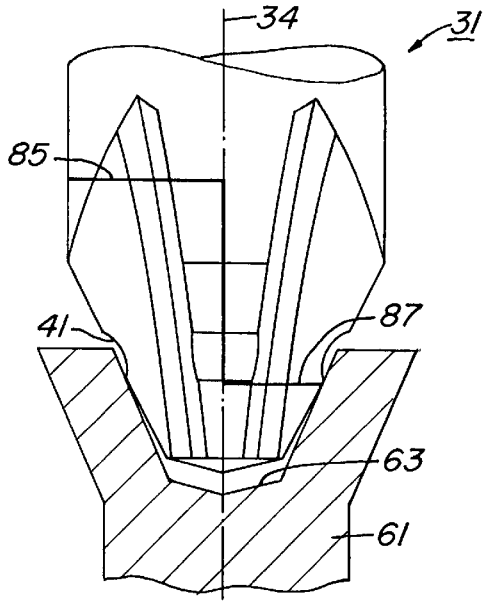
FIG. 9 is a side view of the screwdriver and screw of FIG. 5 illustrating the force and moment arms required during operation.

The advantage of groove 41 is further illustrated in FIGS. 8 and 9. In FIG. 8, the conventional screwdriver 11 of FIG. 1 has a force arm 81 and a relatively long moment arm 83 located at the outer edge of socket 27. In contrast (FIG. 9), screwdriver 31 has the same length force arm 85, but a shorter moment arm 87, resulting in greater force in socket 63 to grip screw 61. The bit section 33 is inserted to a depth that corresponds to the groove 41 being precisely located to straddle the outer edges of socket 63. The distance from the tip 37 to the untapered diameter of the bit 33 divided by the distance from the tip 37 to the moment arm 87 or bottom of groove 41 yields a typical range of the ratio of from 2 to 3. Additional ratios can be computed, such as the distance from the tip 37 to the untapered diameter of the bit 33 divided by the axial distance of the groove 41 yields a typical range of the ratio of from 6 to 7.5.

Figure 6:
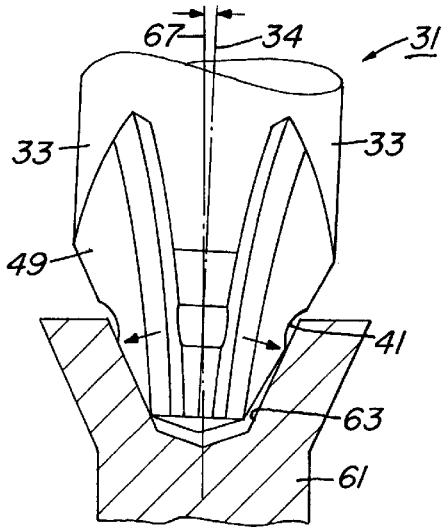
FIG. 6 is a side view of the screwdriver and screw of FIG. 4 showing the range of wobble permitted by the screwdriver.

In addition, groove 41 also allows screwdriver 31 to have a greater amount of tilt or wobble (FIG. 6) relative to axis 67 of screw 61. In essence, groove 41 provides a clearance between the outer edges of socket 63 and blades 49 to allow screwdriver 31 to wobble up to about two degrees per side, or four degrees overall while fully seated in socket 63 and driving screw 61.

Figure 5:
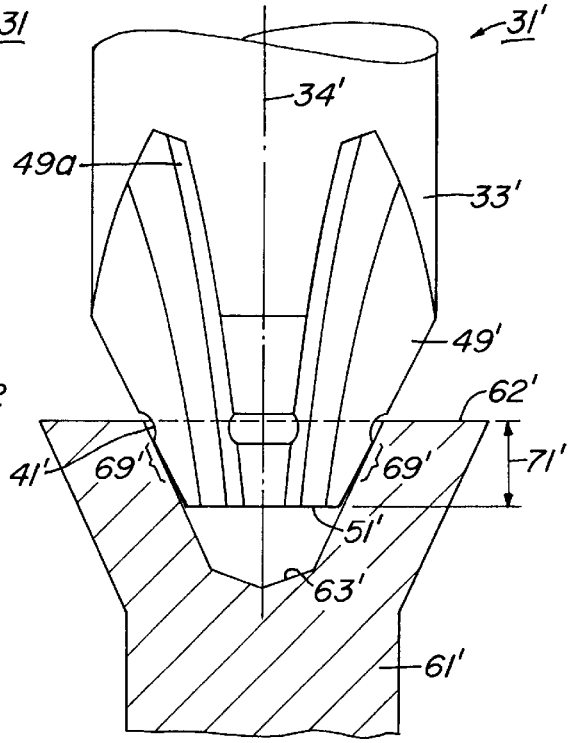
FIG. 5 is a side view of the screwdriver of FIG. 3 after formation of the blades and inserted into the screw of FIG. 4.
Figure 7:
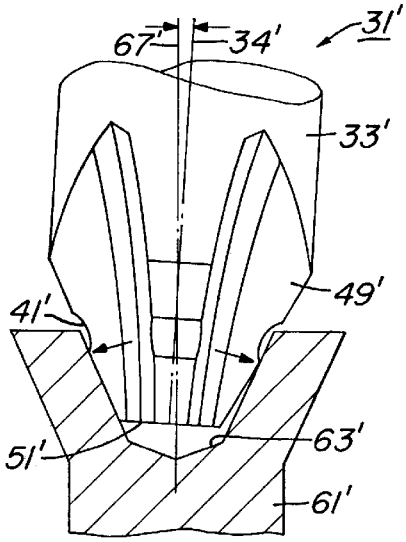
FIG. 7 is a side view of the screwdriver and screw of FIG. 5 showing the range of wobble permitted by the screwdriver.

As shown in FIG. 5, screwdriver 31' with flat tip 51' also relocates the contact area between bit 33' and socket 63' to that shown by brackets 69'. When screwdriver 31' is substantially coaxial with screw 61', contact area 69' is substantially equal to contact area 65 shown in FIG. 4. However, with flat tip 51', screwdriver 31' only inserts into socket 63' to a depth 71' of approximately 0.065 inches, instead of the typical 0.100 inches. This shallow insertion depth also gives screwdriver 31' an even greater range of tilt (FIG. 7) than the embodiment of FIG. 6. Even when fully inserted into socket 63', the axis 34' of screwdriver 31' may be tilted up to about three degrees per side, or six degrees overall, relative to axis 67' of screw 61'. This version of screwdriver 31' with flat tip 51' is particularly advantageous when screws are difficult to access.

Figure 10:
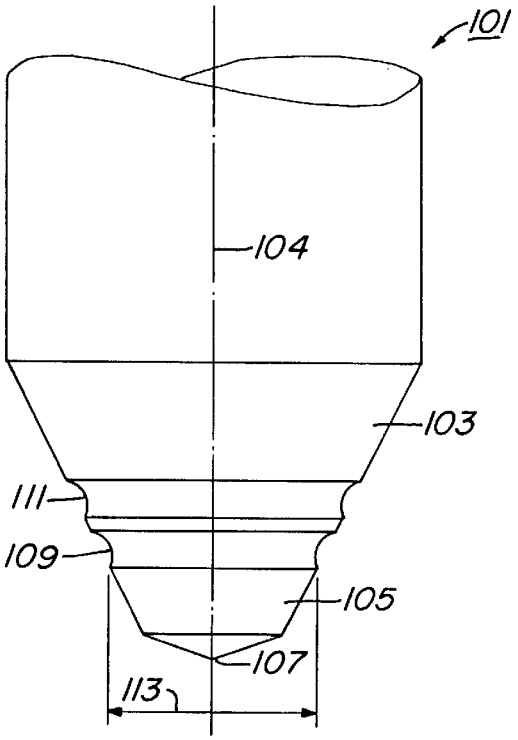
FIG. 10 is a side view of a second embodiment of the screwdriver of FIG. 2 with a tapered tip and prior to formation of the blades of the screwdriver.
Figure 11:
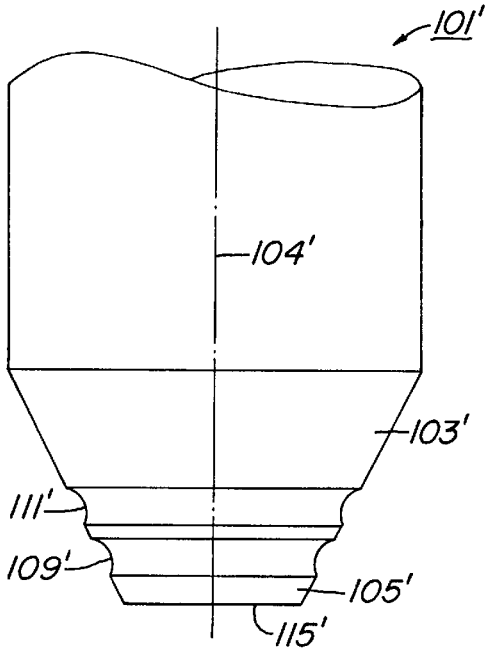
FIG. 11 is a side view of the screwdriver of FIG. 10 with a truncated tip.

Referring now to FIG. 10, a third embodiment of the invention is shown as screwdriver 101. Like screwdriver 31, screwdriver 101 is shown with an unfinished bit 103 prior to the formation of its blades. The diameter of the upper portion of screwdriver 101 is the same and sized as a No.2 Phillips screwdriver. Screwdriver 101 is similar to screwdriver 31 including an axis 104, a conical taper 105, and a sharply tapered conical point 107. However, screwdriver 101 has two parallel, concave, circumferential grooves 109, 111 formed in the exterior of bit 103. Grooves 109, 111 may also be formed in bit 103 after the blades are machined. Again it is clearly understood that the grooves 109, 111 are on each blade and extend across the width of each blade 49. Groove 111 is identical to groove 41 of screwdriver 31 in terms of size, shape, and location. Groove 109 has the same shape and features as groove 111, but is spaced apart from grooves 111 by about 0.008 inches. Groove 109 has a minor diameter 113 of about 0.126 inches. Alternatively, screwdriver 101' may be configured with a flat, frustoconical tip 115' (FIG. 11) as described above for FIG. 3.

Figure 12:
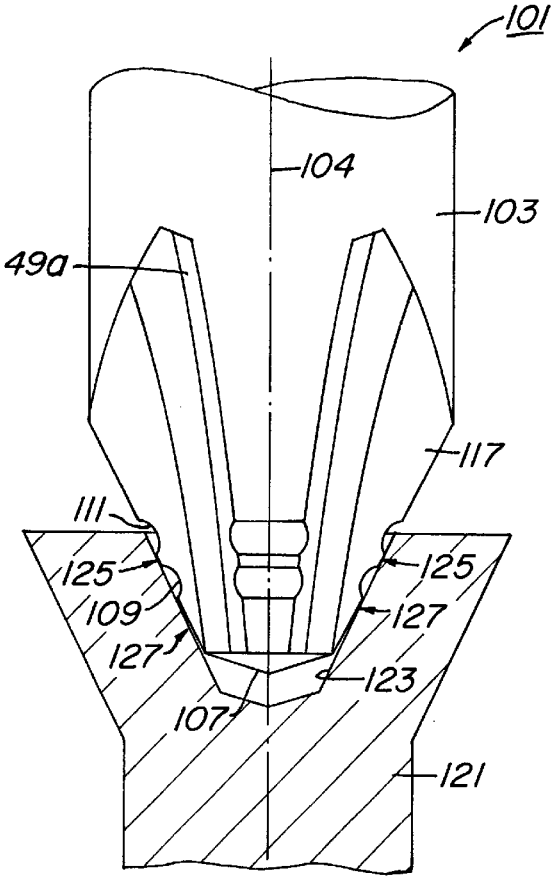
FIG. 12 is a side view of the screwdriver of FIG. 10 after formation of the blades and inserted into the screw of FIG. 1.
Figure 13:
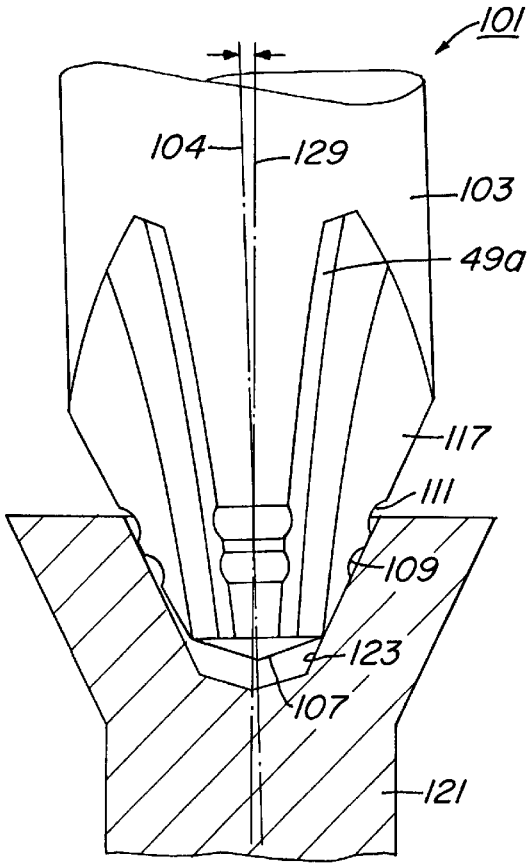
FIG. 13 is a side view of the screwdriver and screw of FIG. 12 showing the range of wobble permitted by the screwdriver.

As shown in FIG. 12, screwdriver 101 has four orthogonal blades 117 that may be formed either before or after grooves 109, 111 are formed in bit 103. Screwdriver 101 is shown inserted in the socket 123 of a No.2 socket screw 121. Groove 111 is precisely located to straddle the outer edges of socket 123 so that portions of groove 111 are located both inside and outside of screw 121. This configuration causes blades 117 to engage socket 123 below its outer edges at the two areas indicated by arrows 125, 127, and reduces the moment arm required to drive screw 121. In addition, groove 111 also allows screwdriver 101 to have a greater amount of wobble (FIG. 13) relative to axis 129 of screw 121. Groove 111 provides a clearance between the outer edges of socket 123 and blades 117 to allow screwdriver 101 to wobble about two degrees per side, or four degrees overall.

Figure 14:
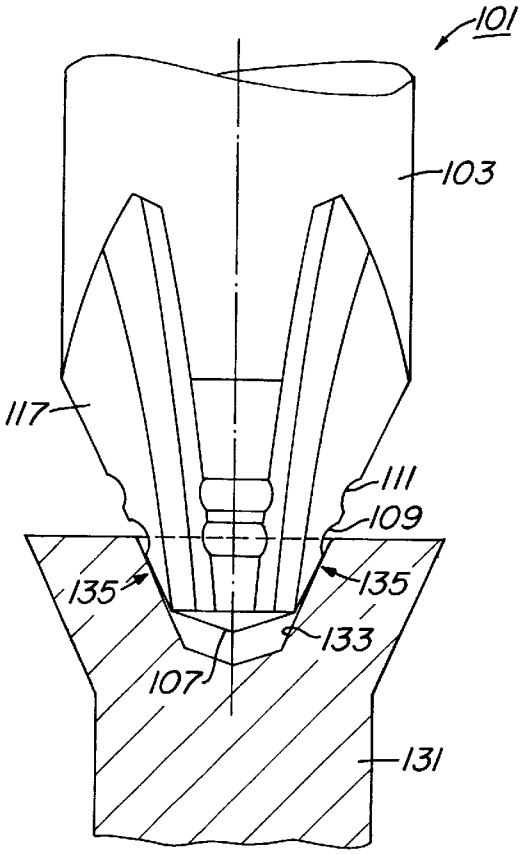
FIG. 14 is a side view of the screwdriver of FIG. 12 inserted into a No.1 Phillips-type screw.
Figure 17:
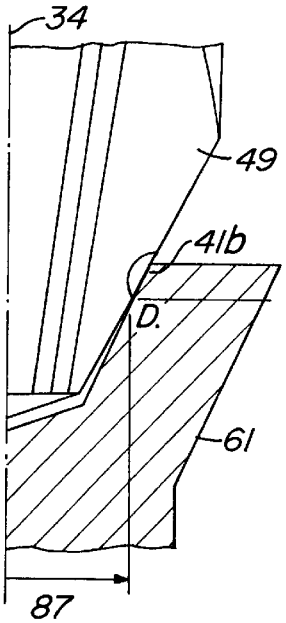
FIG. 17 is a partial view side view of the screwdriver and screw of FIG. 4 showing the bit inserted a depth so that the concave groove substantially aligns with a top portion of the socket, but can not contact the top of the socket.
Figure 18:
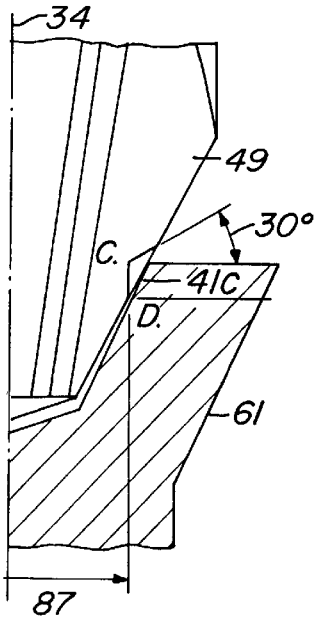
FIG. 18 is a partial view side view of the screwdriver and screw showing the bit inserted a depth so that a flat groove substantially aligns with a top portion of the socket.

FIG. 14 illustrates the use of screwdriver 101 in a smaller No.1 socket screw 131. Socket 133 of screw 131 has the same angle and width as a No.2 screw socket 123 (FIG. 12), but a lesser depth. While engaging screw 131, lower groove 109 straddles the outer edges of socket 133 so that portions of groove 109 are located both inside and outside of screw 121. Groove 111 is located completely outside screw 131. In this use, blades 117 engage socket 133 below groove 109 at the area indicated by arrows 135. Consequently, the No.2 screwdriver 101 effectively drives both No.1 and No.2 screws 121, 131. Naturally, screwdriver 101 may be equipped with grooves that are sized for No.2 and No.3 screws instead of No. 1 and No. 2 screws, or any other combination of sizes including three parallel, circumferential grooves on bit 103 for engaging all three sizes of socket screws.

Figure 16:
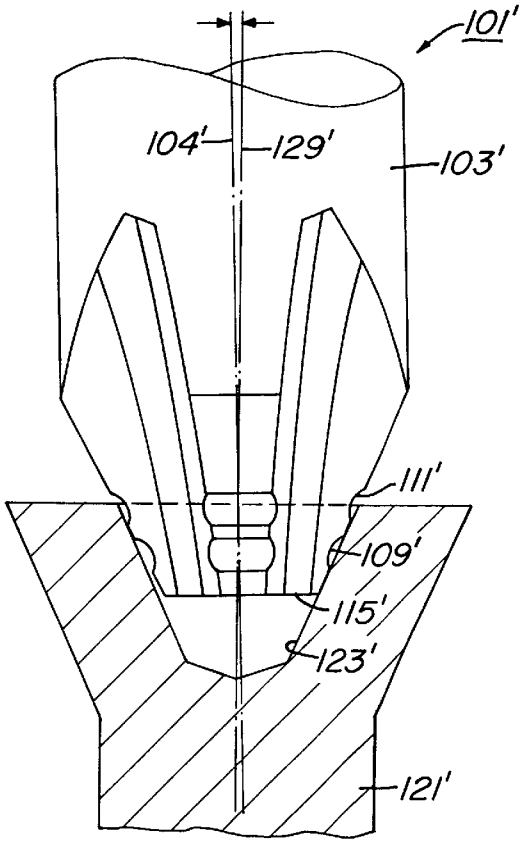
FIG. 16 is a side view of the screwdriver and screw of FIG. 15 showing the range of wobble permitted by the screwdriver.
Figure 15:
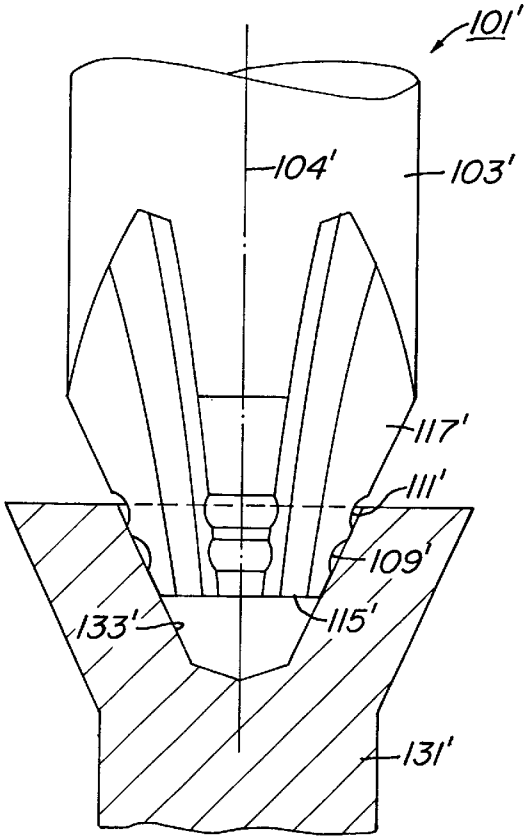
FIG. 15 is a side view of the screwdriver of FIG. 11 after blades have been formed therein and inserted into the screw of FIG. 12.

With flat tip 115' (FIG. 11), screwdriver 101' has a shallower insertion depth into screw 121' (FIG. 15), but operates in the same manner. This shallow insertion depth also gives screwdriver 101' an even greater degree of wobble (FIG. 16). Even when fully inserted into socket 123', the axis 104' of screwdriver 101' may be tilted up to about three degrees per side, or six degrees overall, relative to axis 129' of screw 121'. As described for screwdriver 101 with tapered tip 107 in FIG. 14, screwdriver 101' with flat tip 115' is designed for use with smaller screws as well.

Figure 19:
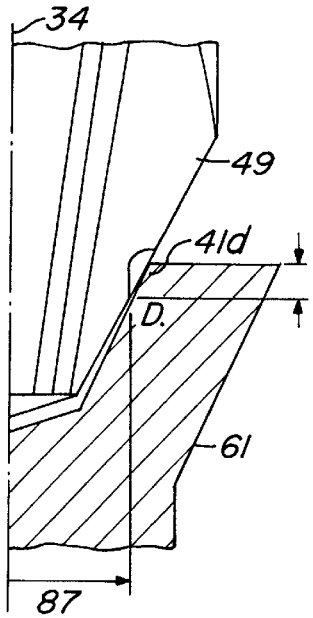
FIG. 19 is a partial view side view of the screwdriver and screw showing the bit inserted a depth so that a combination flat-concave groove substantially aligns with a top portion of the socket.
Figure 20:
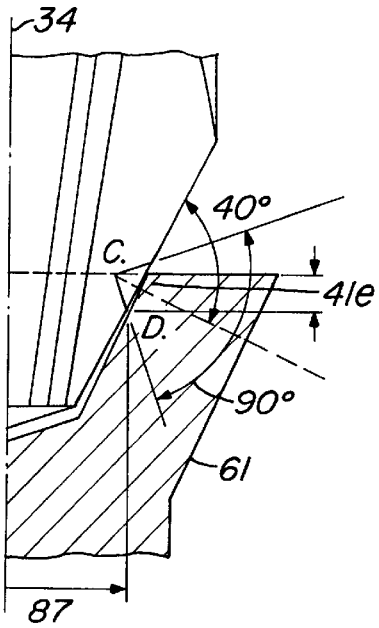
FIG. 20 is a partial view side view of the screwdriver and screw showing the bit inserted a depth so that a V shaped groove substantially aligns with a top portion of the socket.
Figure 21:
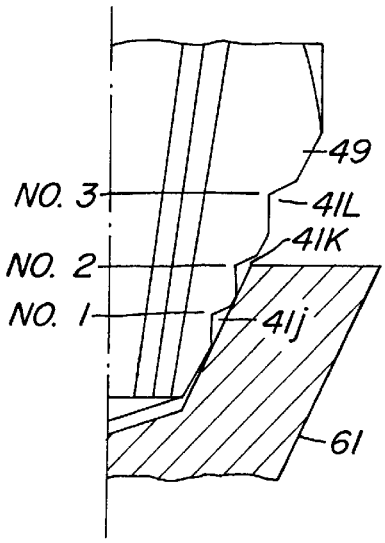
FIG. 21 is a side view of a screwdriver and screw that has three circumferential grooves on the bit for driving either a No. 1, No. 2 or No. 3 Phillips-type screw socket.
Figure 22:
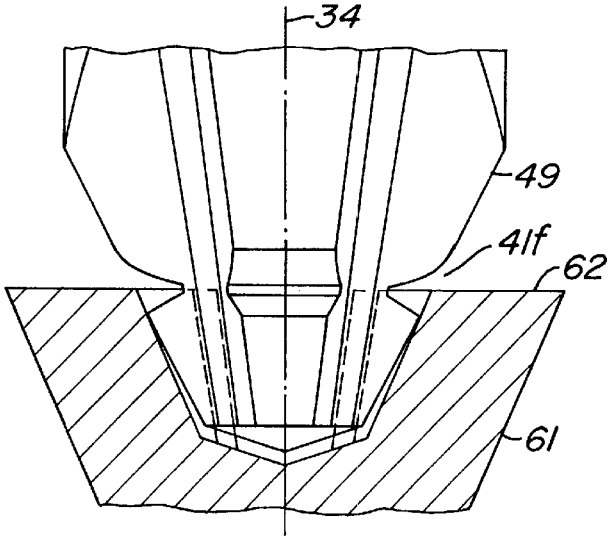
FIG. 22 is a side view of a screwdriver and screw that has a circumferential groove that is a combination of a flat section and a convex section.
Figure 23:
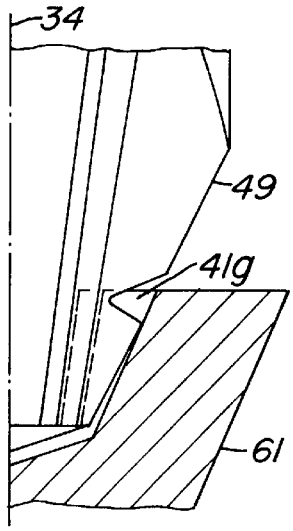
FIG. 23 is a partial side view of a screwdriver and screw that has a circumferential groove that is a combination of a flat section and a flat section.
Figure 24:
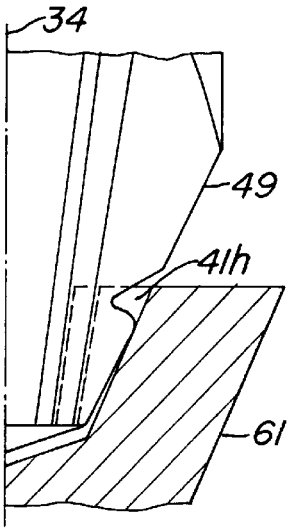
FIG. 24 is a partial side view of a screwdriver and screw that has a circumferential groove that is a combination of two convex curved sections.
Figure 25:
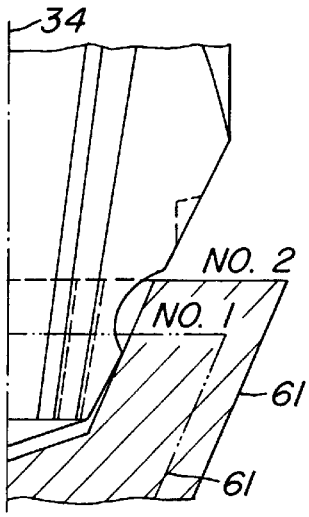
FIG. 25 is a partial side view of a screwdriver and screw that has a circumferential groove that is able to accommodate a No. 1 and No. 2 Phillips-type screw socket.

As shown in FIGS. 17–20, the minimum amount of clearance is designed by selecting the moment arm 87 length, selecting a perpendicular plane at the intersection of the moment arm 87 with the interior of the screw socket 63 at a point D and the intersection of another plane. For all embodiments, varying the groove shape effects both the "cam-out" function of the blades 49 and the amount of force required to pull the blades from within the screw 61. If a round or concave grooves 41*b* are desired on each blade 49 (see FIG. 17), then another plane would be a horizontal plane coaxial with the top of the screw socket 63 would intersect the perpendicular plane at the intersection of the moment arm 87 with the interior of the screw socket 63 at a point D. This location would provide a point on a sphere of a given radius that would remove material from the either the blade 49 or bit section 33. This would be determined by the order of manufacturing the blades 49 versus machining the desired groove shape. If a flat groove 41*c* is desired (see FIG. 18), an angle (30° is shown) is chosen in an elevated position from another plane coaxial with the top of the screw socket 63. A combination groove on each blade 49 wherein a proximal portion is arcuate in cross-section and a distal portion is substantially linear in cross-section 41*d* is shown in FIG. 19. FIG. 20 shows a V-shaped groove 41*e*. FIGS. 22–25 show additional variations of the groove on a typical blade 49. FIG. 22 shows a groove 41*f* in which each of the grooves is generally v-shaped in cross-section, having a convex proximal portion and a convex distal portion. FIG. 23 shows a flat groove 41*g*. FIG. 24 shows two convex curved surfaces which create groove 41*h*. Additional arcuate cross-section shapes are possible. It is possible to vary the geometry of the slot to encompass two different screw sizes with a single circumferential slot. FIG. 25 shows a partial side view of a screwdriver and screw 61 that has a concave groove 41*i* that is able to accommodate a No. 1 and No. 2 Phillips-type screw socket. FIG. 21 shows a screwdriver with a bit that has three grooves 41*j*, 41*k*, 41*l* that allow either a No. 1 Phillips-type, a No. 2 Phillips-type, or a No. 3 Phillips-type screw socket to be driven.

While the invention has been shown or described in only some of its forms, it should be apparent to those skilled in the art that it is not so limited, but is susceptible to various changes without departing from the scope of the invention.

What is claimed is:

1. A screwdriver implement comprising:

a cylindrical metal shaft having an axis coaxial with an insertion direction for driving a screw having a socket;

a cross-point bit section formed on a distal end of the shaft;

the bit section having a central cylindrical core and four blades extending radially therefrom, each of the blades having flat driving faces on opposite sides and an outer edge that tapers relative to the axis, defining a conical configuration for the bit section;

a groove extending across a width of the outer edge of each blade of the bit section in a common plane perpendicular to the axis for providing a clearance between the bit section and an upper edge of the socket of a screw, each of the grooves extending partially through a radial extent of each of the blades toward the cylindrical core.

2. The screwdriver implement as claimed in claim 1 wherein each of the grooves is arcuate in cross-section.

3. The screwdriver implement as claimed in claim 1 in which each of the grooves has a proximal portion that is arcuate in cross-section and a distal portion that is substantially linear in cross-section.

4. The screwdriver implement as claimed in claim 1 wherein the bit section has a distal end that is conical, terminating in a point.

5. The screwdriver implement as claimed in claim 1 wherein the bit section has a distal end that is flat and perpendicular to the axis.

6. In a screwdriver implement and screw, wherein the screwdriver has a shaft having a longitudinal axis and a bit section located on the shaft, the bit section of the screwdriver having a cylindrical core with four blades extending radially therefrom, each of the blades having flat driving faces on opposite sides and a tapered outer edge, defining a conical configuration for the bit section, the screw having an axis, a head with a conical socket having four slots for engagement by the four blades of the screwdriver, the improvement comprising;

a groove extending across a width of an outer edge of each blade of the bit section at a distance from the tip of the bit section that is selected to place the groove flush with an upper end of the screw when the bit section is fully inserted into the socket, each groove extending partially toward the cylindrical core.

7. The screwdriver implement and screw as claimed in claim 6 wherein a distal portion of the groove is recessed below the top of the screw and a proximal portion of the groove is spaced above the top of the screw when the bit section is fully inserted.

8. The screwdriver implement and screw as claimed in claim 6 wherein a tip of the bit section is flat and closer to the grooves than a base of the socket while the bit section is fully inserted.

9. The screwdriver implement and screw as claimed in claim 6 wherein the bit section has a conical tip terminating in a point.

10. A screwdriver implement comprising:

a cylindrical metal shaft having an axis coaxial with an insertion direction for driving a screw having a socket;

a cross-point bit section formed on a distal end of the shaft;

the bit section having a central cylindrical core and four blades protruding radially from the core, each blade having flat drive faces on opposite sides, the bit section having a recess between each adjacent blade, each blade having an outer edge that is inclined relative to the axis, defining a conical taper for the bit section;

a groove extending across a width of the outer edge of each blade of the bit section in a common plane perpendicular to the axis for providing a clearance between the bit section and an upper edge of the socket of a screw, each groove being arcuate in cross-section and extending partially from the outer edge of each blade toward the central core.

11. The screwdriver implement as claimed in claim 10 wherein the bit section has a conical tip that terminates in a point.

12. The screwdriver implement as claimed in claim 10 wherein the grooves are placed above a tip of the bit section a distance selected so that when the bit section is inserted co-axially into a mating screw socket, the grooves will be at side edges of the upper end of the socket.

* * * * *